US006427593B1

(12) United States Patent
Vogt

(10) Patent No.: US 6,427,593 B1
(45) Date of Patent: Aug. 6, 2002

(54) CLAMPING DEVICE HAVING PLURALITY OF PLATE SPRING ELEMENTS

(75) Inventor: Wilfried Vogt, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 43 days.

(21) Appl. No.: 09/677,430

(22) Filed: Oct. 2, 2000

(30) Foreign Application Priority Data

Oct. 1, 1999 (DE) ..... 199 47 499

(51) Int. Cl.[7] ..... B41F 27/12
(52) U.S. Cl. ..... 101/415.1; 101/409; 101/378
(58) Field of Search ..... 101/415.1, 408, 101/409, 382.1, 383, 378; 271/82, 85, 204, 205, 268, 277

(56) References Cited

U.S. PATENT DOCUMENTS 2,378,523 A * 6/1945 Worthington ..... 101/409
5,365,848 A 11/1994 Löhrke ..... 101/415.1

FOREIGN PATENT DOCUMENTS

| | | |
|---|---|---|
| DE | 72 268 | 4/1970 |
| DE | 260 258 A1 | 9/1988 |
| DE | 43 00 099 C1 | 12/1993 |
| DE | 195 11 956 A1 | 10/1996 |

* cited by examiner

*Primary Examiner*—Leslie J. Evanisko
(74) *Attorney, Agent, or Firm*—Laurence A. Greenberg; Werner H. Stemer; Gregory L. Mayback

(57) ABSTRACT

A clamping device having clamping surfaces disposed on both sides of a gap and being movable relative to one another, at least one of the clamping surfaces being formed by lateral surfaces of a plurality of plate-type spring elements, includes, at the lateral surface of each spring element, local projections facing the gap and separated by returns, the spring elements being arranged in a stack so that a projection of a spring element is adjoined by respective returns of adjacent spring elements, each of the projections being disposed over a recess formed in the respective spring element; and a printing cylinder for a printing machine, including the clamping device.

14 Claims, 3 Drawing Sheets

15
12c
12d
16
17
21
12b 16
19
19
17
16
17
12b
20
18
18

12c 12d
21
20
21

CLAMPING DEVICE HAVING PLURALITY OF PLATE SPRING ELEMENTS

BACKGROUND OF THE INVENTION

Field of the Invention

The invention relates to a device for precisely clamping flat objects without play. Clamping devices of this type are used for clamping printing plates on a plate cylinder of a printing machine, for example.

Such a clamping device should enable a precise clamping which remains immobile even when forces act upon the object that is clamped in. A problem that arises in the production of a precise clamping is that it is very difficult to produce exactly parallel clamping surfaces on both sides of a clamping gap over longer distances. The published German Patent Document DE 43 00 099 C1 proposes that this objective be achieved by a clamping device having two clamping surfaces which are disposed on either side of a gap and which are displaceable relative to one another along the width thereof, one of the clamping surfaces being formed by lateral surfaces of a plurality of plate-type spring elements. These spring elements are arranged in succession along the length of the gap and are rotatable to a defined extent in order to achieve parallelism through self-alignment during the tightening or tensioning of the clamping surfaces. But the problem may arise herein that the distribution of the clamping force, though uniform over the length of an individual spring element, varies over the overall length of the gap due to size deviations among the various spring elements. Thus, during the operation of a printing plate which has been clamped in a clamping device of this type, the printing plate may wander several hundredths of a millimeter before finding a final position. Because no prediction can be made when clamping a printing plate as to whether and in what direction such wandering will occur, the wandering naturally interferes greatly with the print results obtained by using the plate.

SUMMARY OF THE INVENTION

It is accordingly an object of the invention to provide a clamping device for flat objects which ensures uniform clamping over the longitudinal extent of a gap and which prevents wandering.

With the foregoing and other objects in view, there is provided, in accordance with one aspect of the invention, a clamping device having clamping surfaces disposed on both sides of a gap and being movable relative to one another, at least one of the clamping surfaces being formed by lateral surfaces of a plurality of plate-type spring elements, comprising, at the lateral surface of each spring element, local projections facing the gap and separated by returns, the spring elements being arranged in a stack so that a projection of a spring element is adjoined by respective returns of adjacent spring elements, each of the projections being disposed over a recess formed in the respective spring element.

In accordance with another feature of the invention, the respective projection is disposed centrally over the recess and is carried by arms at opposite sides thereof.

In accordance with a further feature of the invention, mutually adjacent ones of the recesses are separated by a bridge having a longitudinal extent that is at the most half that of the recesses.

In accordance with an added feature of the invention, each of the spring elements has a lateral surface facing away from the gap and formed with a projection located across from the respective projection of the lateral surface facing the gap.

In accordance with an additional feature of the invention, the spring elements arranged in the stack are in staggered formation, so that an end of a respective projection of one of the spring elements is adjoined in the longitudinal direction by a beginning of a respective projection of another of the spring elements.

In accordance with one alternative feature of the invention, the projections of a plurality of the spring elements form a spar pattern.

In accordance with another alternative feature of the invention, the projections of a plurality of the spring elements form a pattern symmetrical to a central plane of the stack.

In accordance with yet another feature of the invention, an odd number of spring elements is provided.

In accordance with yet a further feature of the invention, the length of the projections is at least $2/(n-1)$ times the length of the returns, and preferably $2/(n-3)$ times the length, wherein n is the number of spring elements.

In accordance with an added feature of the invention, the spring elements are formed of steel, and particularly of a chrome-nickel steel.

In accordance with an additional feature of the invention, the spring elements have a thickness of from 0.3 to 1 mm, and the projections have a length of from 5 to 20 mm.

In accordance with a concomitant aspect of the invention, there is provided a printing cylinder for a printing machine, comprising a clamping device for clamping a printing plate, having at least one of the foregoing features.

Preferably, each projection of a respective spring element of this type is disposed over a recess which enables the projection to yield resiliently or elastically in the direction of the recess under an exerted pressure. The projection is preferably disposed over the recess centrally and carried at two sides by arms.

Adjacent recesses of a spring element are preferably separated by a bridge having a longitudinal extent that is at most half as great as that of the recess. This makes it possible to hold the stack of spring elements together by pins or screws extending through the recesses and potentially through a borehole formed in the bridge.

According to a preferred development, the spring elements have bridges not only at the lateral surface facing the gap, but also at an opposite lateral surface which faces away from the gap. It is therefore possible to halve the spring constants of the spacing elements while maintaining the same material thickness, and thus to compensate for larger deviations from the parallelism of the clamping surfaces than would be possible using a spring element that is elastic only on one side.

In order to achieve an optimally uniform hold for the clamped object, the spring elements of the stack are preferably arranged in a staggered pattern, so that an end of a projection is adjoined by the beginning of a projection of another spring element in the longitudinal direction.

This type of arrangement can be an arrangement of projections in a diagonally striped pattern, for example. A particularly preferred arrangement is one wherein the diagonal stripes form a spar pattern, because forces which could effect a shifting of the clamped object along the length of the gap largely compensate for one another, if such a pattern is provided.

For the same reason, a pattern of projections which is symmetrical with respect to a central plane of the stack, the central plane extending parallel to the longitudinal direction, is generally preferred.

This type of pattern can be realized economically by employing an odd number of spring elements. In this case, the central plane extends through the central spring element of such a stack.

To ensure that, over the length of the gap, at least one projection of a symmetrical pattern is always in contact with the clamped object, the length of the projections must equal at least 2/(n−1) times the length of the returns, where n is the number of spring elements. Assuming a spar pattern, in order to ensure an overlapping of the spars on the width of at least one projection, the length should rather equal 2/(n−3) times.

The spring elements can advantageously be formed of steel, particularly a nickel-chromium steel. Advantageous dimensions, particularly assuming the use of the clamping device in a printing cylinder of a printing machine, are a thickness of 0.3 to 1 mm of the spring elements, and a length of the projections of 5 to 20 mm.

Other features which are considered as characteristic for the invention are set forth in the appended claims.

Although the invention is illustrated and described herein as embodied in a clamping device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENT

Figure 1:
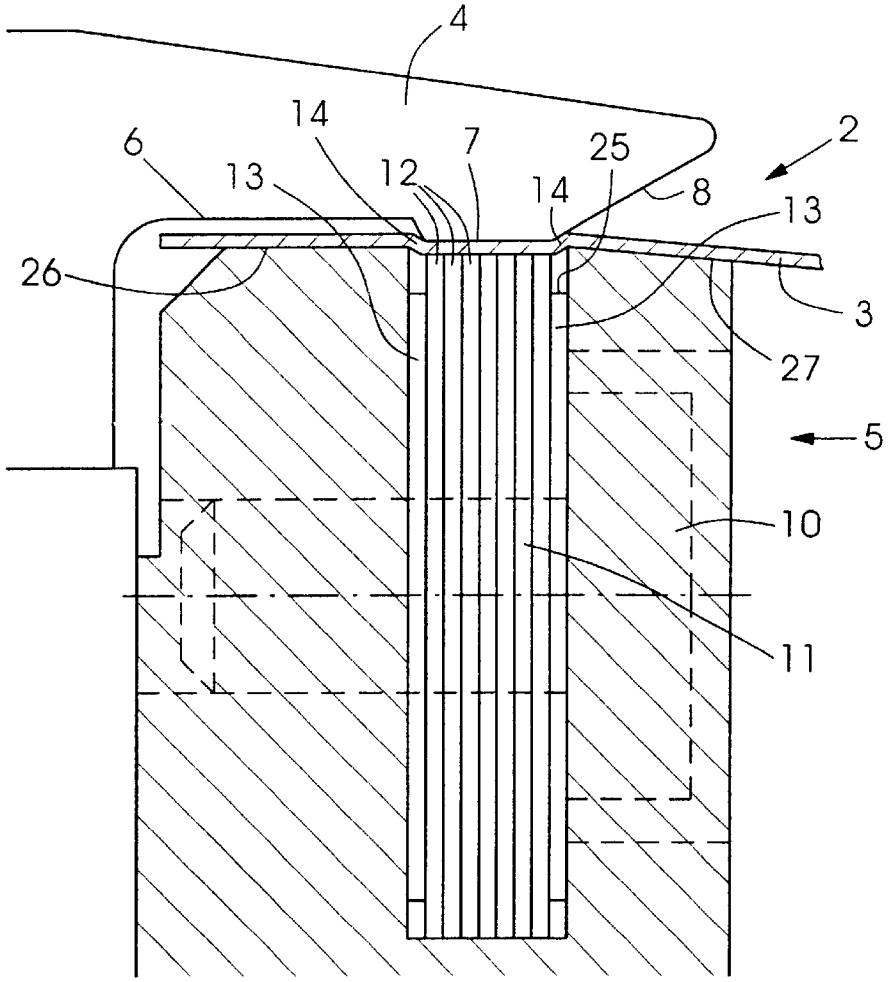
FIG. 1 is a fragmentary diagrammatic cross-sectional view of a clamping device according to the invention, the cross-sectional view being taken transversely to the length of a cylinder gap.

Referring now to the drawings and, first, particularly to FIG. 1 thereof, there is shown therein a portion of the clamping device according to the invention, taken along a plane lying perpendicularly to the longitudinal direction of a cylinder gap 2. In the gap 2, a flat object 3, for example a printing plate, is securely clamped between two clamping bars 4 and 5 which extend along the gap 2 longitudinally. For the purpose of clamping and releasing the flat object 3, the two clamping bars 4 and 5 are adjustably movable with respect to one another in the direction of the width of the gap, i.e., vertically in FIG. 1, by a suitable non-illustrated mechanism. An example of a suitable adjusting mechanism is described in the published German Patent Document DE 43 00 099 C1.

The inner wall of the top clamping bar 4, facing and defining the gap 2, includes a foot portion 6, a clamping portion 7 that projects fractions of a millimeter downwardly, relative to the foot portion 6, into the gap 2, and an entry portion 8 defining an oblique inlet region of the gap 2. The bottom clamping bar 5 is formed with a groove 11 which is situated opposite the clamping portion 7 of the top clamping bar 4 and in which a stack of seven spring plates 12 is disposed, this stack being surrounded on both sides thereof by respective spacer plates 13. The spring plates 12, respectively, have narrow lateral surfaces 15 facing towards and away from the gap 2. The side surfaces 15 facing away from the gap 2 rest on the base or floor of the groove 11.

Boreholes for screws 10 are distributed over the length of the bottom clamping bar 5, and have an inner thread portion on one side of the groove 11 and a portion of greater diameter on the other side of the groove 11 for accepting the screw head therein. The screws 10 that are placed therein penetrate suitable openings formed in the spring plates 12 and the spacer plates 13 with play and hold the plates 13 against inner side walls of the bottom clamping bar 5 defining the groove 11.

The stack of spring plates 12 has a width corresponding to the width of the clamping portion 7 of the top clamping bar 4 facing towards it. During the tight clamping of the object 3, the spring plates 12 are slightly compressed elastically, so that the narrow lateral surfaces 15 thereof, which face towards the gap 2, spring back behind the corresponding lateral surfaces 26 and 27 of the clamping bar 5. This results in a deformation of the flat object 3 as is illustrated in FIG. 1 with two crank zones 14, respectively, on opposite sides of the clamping portion 7. The spacer plates 13 have provided for the purpose of preventing the flat object 3 from being sheared off in the region of the crank zones 14. The spacer plates 13 have narrow lateral surfaces 25 facing towards the gap 2, which spring back relative to the corresponding lateral surfaces 26 and 27 of the clamping bars and the lateral surfaces 15 of the spring plates 12, respectively.

Figures 2A, 2B, 2C, 2D:
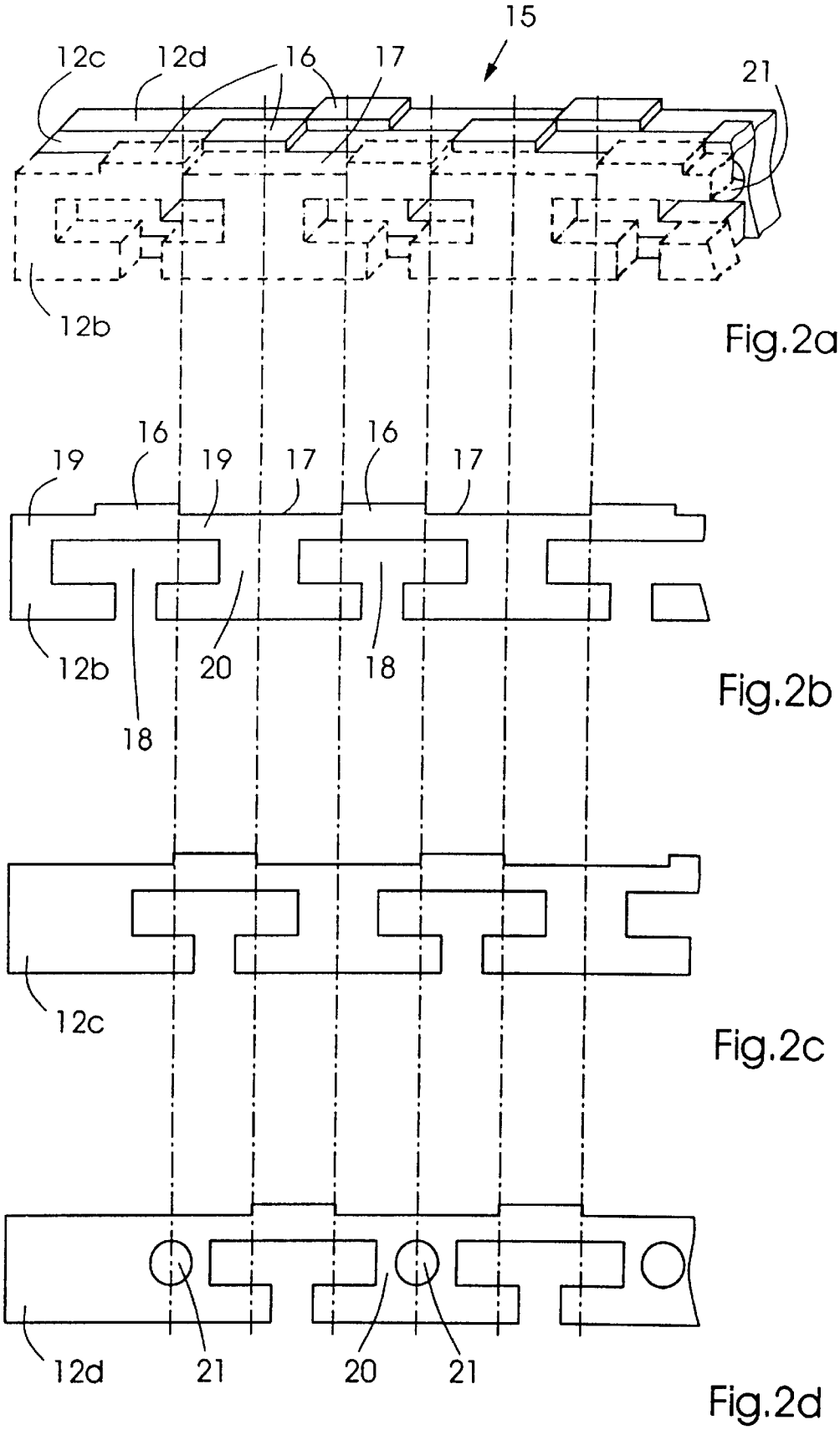
FIG. 2*a* is a front, top and side perspective view of three spring elements 12*b,* 12*c* and 12*d* according to a first embodiment of the clamping device, and FIGS. 2*b,* 2*c* and 2*d* are front elevational views of the three spring elements 12*b,* 12*c* and 12*d,* respectively.

FIG. 2*a* shows the arrangement and construction of three spring plates 12*b,* 12*c* and 12*d,* which are disposed in the groove 11 according to a first embodiment of the invention. Thus, FIG. 2*a* is a perspective view of the arrangement of the three spring elements 12*b,* 12*c* and 12*d* forming a part of a stack thereof which is arranged in the groove 11 in FIG. 1, and FIGS. 2*b,* 2*c* and 2*d* are plan views of the individual spring elements 12*b,* 12*c* and 12*d.* As can be seen in FIG. 2*b,* each spring element 12*b,* for example, has a lateral surface 15 facing towards the gap 2, which includes a plurality of projections 16, which are separated from one another by returns 17 having double the width of the projections. A recess 18 is disposed beneath each of the projections 16, and has a width which is twice that of the projections 16. The projections 16 are connected to the rest of the spring plates by two arms 19, respectively, which can yield elastically under a force loading the projections 16, maximally until the projections 16, respectively, are flush with central portions of the returns 17, where the latter are supported by a massive brigde 20.

The spring plates 12*c* and 12*d* differ from the spring plate 12*b* in that the pattern of projections 16 and recesses 18, respectively, in the spring plates 12*c* and 12*d,* is laterally offset by a third and two-thirds, respectively, of the period thereof.

As can be seen in FIG. 2*d,* the boreholes 21 formed in the bridges 20 of the spring element 12*d,* together with the recesses 18 of the other spring elements 12*b* and 12*c,* can serve as a through passage for the screws 10 shown in FIG. 1. In the interest of simplifying production, the other spring plates 12*b* and 12*c,* respectively, can also be formed with such boreholes 21 arranged centrally in the bridges 20.

The projections 16 of the spring plates 12*b* to 12*d* form an unbroken sequence over the length of the gap 2. Where a projection 16, for example, of spring element 12*b,* terminates in the longitudinal direction of the gap 2, a corresponding projection of the succeeding spring element 12*c* begins. Based upon this staggered arrangement, the spring plates are in a position to clamp an object over the entire length thereof without any interruption. It is not absolutely necessary that the beginnings and endings of the projections 16 coincide precisely; a space may arise between consecutive projections 16 as long as it is small enough that it does not cause shear distortions of the clamped object. A partial overlapping of projections 16 following one another in the longitudinal direction is not precluded, either.

Figure 3:
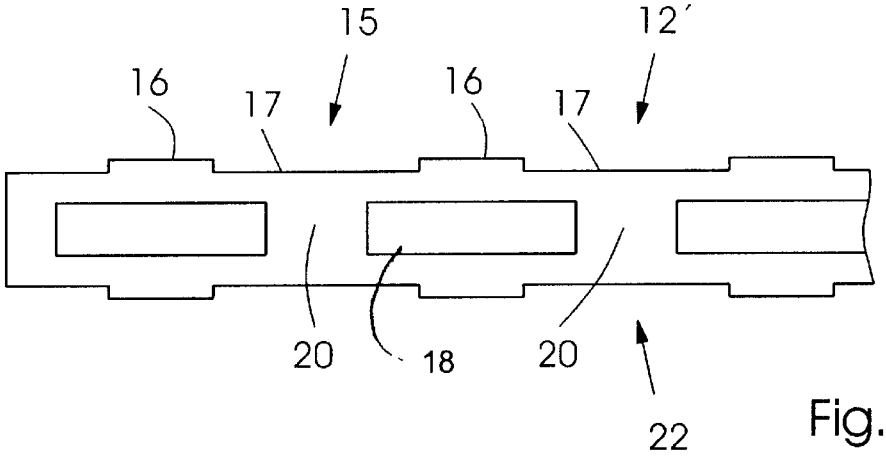
FIG. 3 is a view like those of FIGS. 2*b,* 2*c* and 2*d* of a second embodiment of the spring element.

FIG. 3 shows a portion of another embodiment of a spring element of a clamping device according to the invention. The series of projections 16 and returns 17 at the lateral surfaces 15 of this spring element 12' facing towards the gap 2 corresponds to the arrangement that has been described hereinbefore with reference to FIG. 2. Here as well, a recess 18 having twice the width of the projection 16 is disposed beneath each projection 16. The bridges 20 situated between pairs of the recesses 19 can again be formed with a borehole, which is not otherwise illustrated in FIG. 3.

Figure 4:
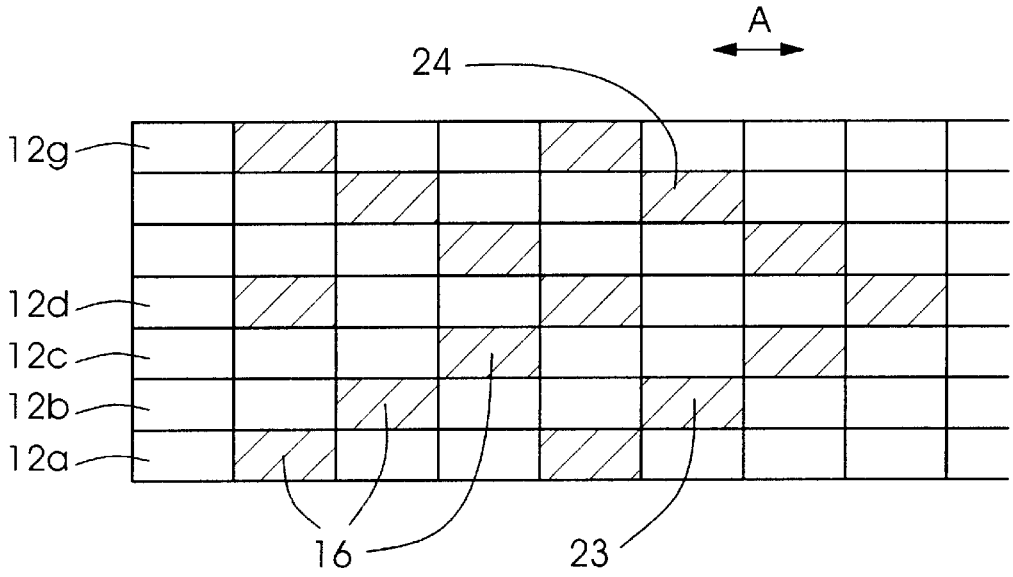
FIG. 4 is a plan view of lateral surfaces of the spring elements.

The lateral surface 22 of the spring element 12' facing the base or floor of the groove 11 is formed as a mirror image of the lateral surface 15. When this spring element 12' is pressed against an object that is being clamped, the projections of the two lateral surfaces 15, 22 can yield. The spring element 12' is therefore more yielding than that of FIG. 2 and is thus suitable for compensating for greater deviations in the parallelism of the two clamping bars 4 and FIG. 4 is a plan view of the lateral surfaces of a stack of seven spring elements 12*a,* 12*b*, . . . , 12*g* in a preferred arrangement. Here, the respective projections 16 of the spring elements 12*a* to 12*d* and 12*d* to 12*g* form rows 23 and 24, respectively, which are oriented transversely to the longitudinal direction, represented by the arrow A, of the clamping device. The rows 23 and 24 run in opposite directions and are equally long, so that a tensile force acting upon the clamped object perpendicularly to the longitudinal direction A does not give rise to a resulting force in the longitudinal direction. The oblique rows 23 and 24 form a spar or rafter pattern which repeats in the longitudinal direction over the entire extent of the clamping device. The projections of the two extreme spring elements 12*a* and 12*g* and of the middle spring element 12*d* thus overlap in the longitudinal direction. This overlap is in the interest of an optimally uniform distribution of the clamping force over the entire length of the clamping device.

The use of seven spring elements with a ratio of the widths of projections and returns of 1:2 is viewed as an expedient compromise between the desired flexibility of the spring elements and the complexity of the construction of the clamping device. If greater flexibility is desired, it would be possible without further ado to increase the number of spring elements, for example, to nine, and to adjust the width ratio to 1:3, in order thereby to achieve an increased arm length and thus more flexible spring elements, assuming that the width of the recesses remain corresponding to the width of the returns.

When the clamping mechanism according to the invention is used to clamp a printing plate at the start of printing by an impression cylinder of a sheet-fed printing machine, the following dimensions of the spring elements are expedient:

Width of the projections 16=approx. 12 mm

Width of the returns 17=approx. 24 mm

Width of the recesses 18=approx. 24 mm

Depth of the returns=1.5 mm

Thickness of the arms=3.5 mm

Thickness of the spring plates=0.6 mm

I claim:

1. A clamping device, comprising:

clamping surfaces adapted to be disposed on both sides of a gap and being movable relative to one another;

a plurality of plate spring elements each having lateral surfaces, at least one of said clamping surfaces being formed by said lateral surfaces of said plate spring elements;

each of said plate spring elements having local projections adapted to face said gap, returns located between and separating said local projections and a recess formed therein; and said plate spring elements being disposed in a stack causing each of said local projections of each of said plate spring elements to be adjoined by respective returns of adjacent plate spring elements, each of said projections being disposed over said recess formed in a respective one of said plate spring element.

2. The clamping device according to claim 1, wherein each of said plate spring elements further comprises arms and the respective projection is disposed centrally over said recess and is carried by said arms at opposite sides thereof.

3. The clamping device according to claim 1, wherein mutually adjacent ones of said recesses are separated by a bridge having a longitudinal extent that is at the most half that of said recesses.

4. The clamping device according to claim 1, wherein each of the spring elements has a lateral surface facing away from the gap and formed with a projection located across from the respective projection of the lateral surface facing the gap.

5. The clamping device according to claim 1, wherein the spring elements arranged in the stack are in staggered formation, so that an end of a respective projection of one of the spring elements is adjoined in the longitudinal direction by a beginning of a respective projection of another of the spring elements.

6. The clamping device according to claim 1, wherein the projections of a plurality of said plate spring elements form a spar pattern.

7. The clamping device according to claim 1, wherein the projections of a plurality of said plate spring elements form a pattern symmetrical to a central plane of the stack.

8. The clamping device according to claim 1, wherein an odd number of spring elements is provided.

9. The clamping device according to claim 8, wherein the length of the projections is at least $2/(n-1)$ times the length of the returns, wherein n is the number of spring elements.

10. The clamping device according to claim 8, wherein the length of the projections is at least $2/(n-3)$ times the length of the returns, wherein n is the number of spring elements.

11. The clamping device according to claim 1, wherein the spring elements are formed of steel.

12. The clamping device according to claim 1, wherein the spring elements are formed of chromium-nickel steel.

13. The clamping device according to claim 1, wherein the spring elements have a thickness of from 0.3 to 1 mm, and said projections have a length of from 5 to 20 mm.

14. A printing cylinder for a printing machine, comprising a clamping device for clamping a printing plate, in accordance with claim 1.

* * * * *